US005279472A

United States Patent [19]

Hongo et al.

[11] Patent Number: 5,279,472

[45] Date of Patent: Jan. 18, 1994

[54] PAPER FEEDING DEVICE AND AN APPLICATION THEREOF

[75] Inventors: Takayasu Hongo, Kobe; Setuo Sasabe, Osaka; Eiji Hirao, Amagasaki, all of Japan

[73] Assignee: Kanzaki Paper Manufacturing Co., Ltd., Tokyo, Japan

[21] Appl. No.: 943,317

[22] Filed: Sep. 10, 1992

Related U.S. Application Data

[62] Division of Ser. No. 624,541, Dec. 10, 1990, Pat. No. 5,174,518.

[30] Foreign Application Priority Data

Dec. 12, 1989 [JP] Japan ..... 1-143940[U]
Dec. 16, 1989 [JP] Japan ..... 1-145281[U]

[51] Int. Cl.[5] ..... B65H 16/02

[52] U.S. Cl. ..... 242/68.7; 242/55.53; 242/75.4

[58] Field of Search ..... 242/68.7, 78.7, 55, 242/55.53, 75.4, 75.45, 76; 312/34.8, 34.18, 34.19, 34.21, 34.22, 34.23, 34.24

[56] References Cited

U.S. PATENT DOCUMENTS 1,340,710 5/1920 Graham .
1,807,274 5/1931 Beidler ..... 242/75.45
1,967,119 2/1931 Gluck .
2,267,962 12/1941 Tishken ..... 242/68.7 X
2,574,175 11/1951 Erhardt ..... 242/55.53
3,045,883 7/1962 Andrews et al. .
3,649,447 3/1972 Turner ..... 242/75.45 X
3,669,370 6/1972 Mason ..... 242/68.7 X
4,179,077 12/1979 Morishita ..... 242/75.4 X
4,246,817 1/1981 Marsh et al. ..... 242/55.2 X
4,497,453 2/1985 Butcher ..... 242/68.7
4,597,241 7/1986 Clostermeyer ..... 242/55.2 X
4,915,319 4/1990 Gerber ..... 242/75.4 X

*Primary Examiner*—John M. Jillions
*Attorney, Agent, or Firm*—Morgan & Finnegan

[57] ABSTRACT

A paper feeding device for a printer comprising a paper feed box for containing a paper roll. The device includes a bottom slanting to the front and a front wall defining the lower edge of a drawing outlet for unrolled paper portions of the roll. The paper roll freely contacts both of the bottom and the front wall. The paper feed box may be supported by a spring at the undersurface of the feed box capable of rising and falling. Slip guide means may be provided at a predetermined position above the paper feed box so that when the paper roll is placed in the paper feed box, the upper end of the paper roll is pressed to the guide means and unrolled paper is drawn from the roll around the guide means.

4 Claims, 5 Drawing Sheets

PAPER FEEDING DEVICE AND AN APPLICATION THEREOF

This is a divisional of co-pending application Ser. No. 07/624,541 filed Dec. 10, 1990, now U.S. Pat. No. 5,174,518.

BACKGROUND OF THE INVENTION

The present invention relates to a paper feeding device for drawing a blank paper from a paper roll and feeding it to a printer or the like.

A paper roll is frequently used as the source of recording paper in a printer and in a facsimile equipment.

Usually, a paper roll is used continuously or used on occasion in response to printing input and other factors with no operator interaction once the roll is set. In many cases no trouble can be found with this arrangement, thereby avoiding maximum inconvenience. However, practical handling of the paper roll is very difficult and the problems such as follows may often occur in the paper feeding process of drawing a length of blank paper from the paper roll.

1) For example, in a process in which a paper roll is freely contactively supported on the bottom of a paper-containing box with no support for the axis thereof and the blank paper is drawn, the paper roll moves up-and-down around the contact point P on the front wall of the housing C as the fulcrum by the drawing force F for the paper roll as shown in FIG. 11 to cause fluctuation of tension F applied on the blank paper and meandering of the blank paper, thus making drawing of the blank paper unstable and often causing disorder in the printed matters.

When the blank paper is drawn by supporting the center O of the paper roll with a fixed shaft R as shown in FIG. 12, it is required to give a damping torque to establish a proper tension F when the paper roll is drawn and thus it is required to provide a mechanism for forming frictional resistance on the fixed shaft R.

As the diameter of the paper roll changes gradually during feeding, a complex mechanism is required to give proper friction, resulting in high equipment cost.

2) A paper roll has a curl, with a part of smaller diameter having a higher curl. In order to prevent trouble, it is required to remove the curl with any method.

To remove the curl from the paper roll, it is required to draw the paper with a tension corresponding the degree of curl in a condition such that the paper roll is curved in a sense opposite to the existing curl. For this purpose, devices in the prior art have been so constituted that a constant brake force is applied on the shaft for supporting the paper roll to draw the paper with a tension not lower than a predetermined level. The effect of the method for removing curl depends on the curve diameter and the tension applied on the paper. The curvation diameter is constant by the diameter of a curl removing roller. Hence, the effect for removing curl is determined by the tension applied on the paper.

The tension applied on the paper should be defined by the brake force of the shaft for supporting the paper roll. The brake force applied on the shaft for supporting the paper roll would be constant in a conventional brake mechanism. There has been a difficulty that the curl could not be removed completely in the course of a gradual reduction in the diameter of the paper roll.

There has been also a difficulty that devices to adjust the brake force of the paper roll in accordance with the varying diameter of the paper roll are too complex and, thus too high in price.

The principal object of the present invention is to provide an economic paper feeding device which can feed unrolled paper in a stable manner.

Another object of the present invention is to provide a simple device which can stably draw unrolled paper from a paper feeding box and feed the unrolled paper to a recording part.

The third object of the invention is to provide a paper feeding device which can feed unrolled paper stably in a condition suitable for use by simple equipment.

The fourth object of the present invention is to provide an economic printer equipment which can handle the blank paper stably and can be used efficiently.

SUMMARY OF THE INVENTION

The paper feeding device for a printer of the present invention comprises a paper feed box for containing a paper roll which has a bottom slanting to the front and a front wall defining the lower edge of a drawing outlet for unrolled paper portions of the roll. The paper roll freely contacts both of said bottom and said front wall, and the paper feed box includes on an inside portion a pair of guide plates to press substantially the front half segment portion of both sides of the paper roll. Unrolled paper of the paper roll thereby be drawn upward to the drawing outlet along the front wall of the paper feed box and then laterally drawn out of the box.

In another aspect of the present invention, a device can be provided with a constitution: it comprises a pair of idler shafts or rollers supported by a spring capable of rising and falling, and a slip guide shaft provided at a predetermined position above the shafts or the rollers so that when the paper roll is placed on the pair of idler shafts or rollers, the upper end of the paper roll is pressed to the guide shaft and unrolled paper of the roll is drawn around the guide shaft.

In the present invention, a printer device containing a mechanism which can stably feed paper and print thereon can be provided.

DETAILED DESCRIPTION OF EXAMPLES

Figure 1:
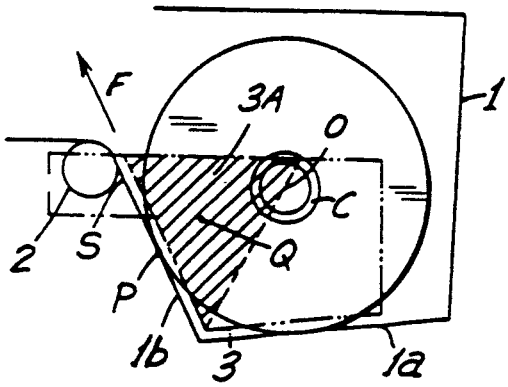
FIGS. 1 and 2 are side sectional views showing in outline a paper feeding device of an example of the present invention.

FIG. 1 shows an example of the present invention. In FIG. 1, the numeral 1 designates a paper-containing box for paper feed and its bottom 1*a* is slanted to the front so that a paper roll S contacts both of the bottom 1*a* and the front wall 1*b* of the box 1 by its own weight when placed in the box. The front wall 1*b* is also somewhat inclined toward the draw-out side at the upper end so that the paper roll S is pressed on both the bottom 1*a* and the front wall 1*b* forming an obtuse angle with each other.

The numeral 2 designates a sliding shaft and it is provided at the upper part of the front wall of the box 1 to curve the paper drawn from the roll in a reverse direction from its rolled direction to remove the curl from the paper and guide it to the printing part.

A pair of guide plates 3*a*, 3*b* generally designated together by 3 are provided. At least one of the guide plates is slidable along the axis of the roll in the inner side of the side walls of the box 1.

Figure 2:
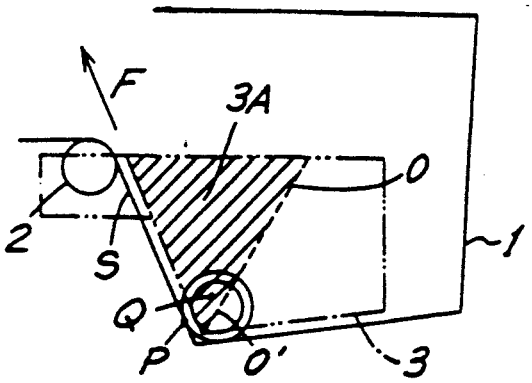
Figure 3:
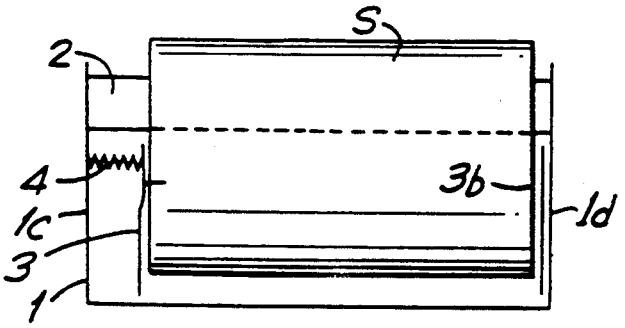
FIG. 3 is a front sectional view of the structure of FIG. 1.
Figure 11:
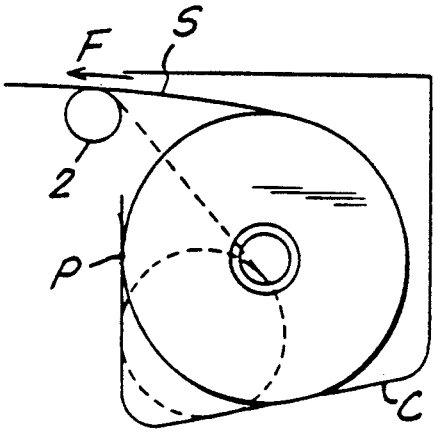
PRIOR ART FIG.11
FIGS. 11 and 12 are, respectively, outlined side views of conventional free supporting system and shaft supporting system for paper roll.
Figure 12:
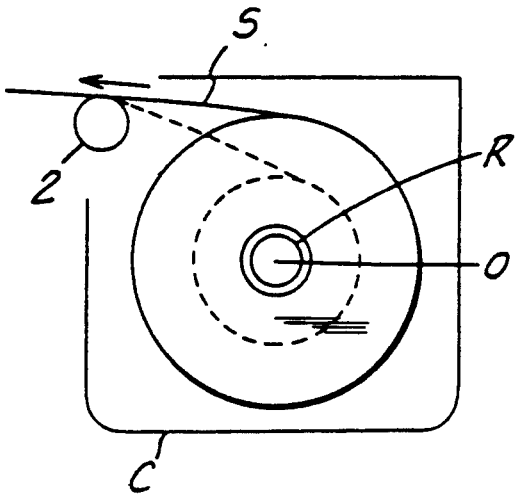
PRIOR ART FIG.12

As a structure relating to the guide plates in the box 1, a spring 4 is provided between the guide plate 3*a* and side wall 1*c* as shown in FIG. 3. The spring 4 always presses the hatched front lower half part 3A of the guide plate 3 in FIGS. 1 and 2 to the side of the paper roll.

Figure 4:
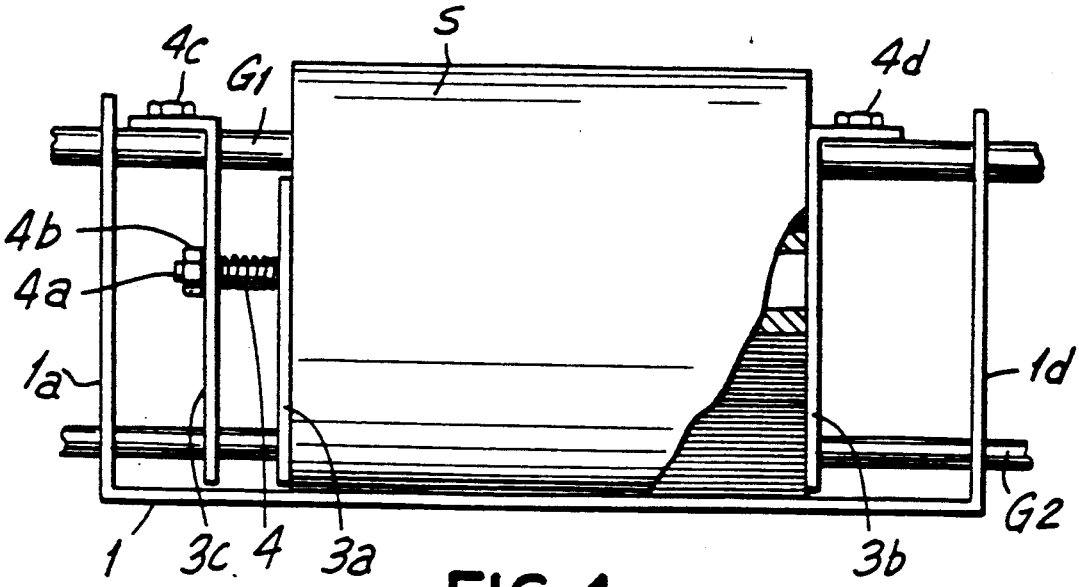
FIG. 4 is a front sectional view showing its detailed structure.
Figure 5:
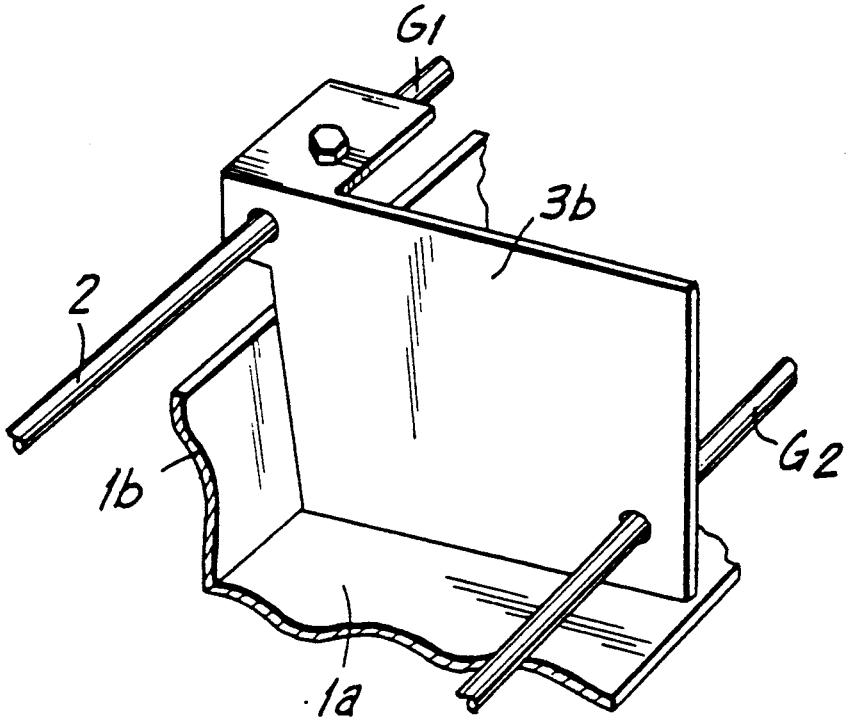
FIG. 5 is its partial perspective view.

FIGS. 4 and 5 show an Example of the mechanism pressing the guide plate to the side of the paper roll. An adjusting plate 3C holding a guide plate 3*a* and another guide plate 3*b* is held vertically by two guide rods G1, G2 provided parallel to the axis of the paper roll. The guide rod G2 passes through the paper feed box (lower right part in FIG. 1) and both ends are fixed to the side walls of the box. The guide rod G1 can be fixed near the upper edge of the box and it can be also used as the sliding shaft 2.

The numeral 4 designates a pressing spring. It is set at a required pressure by a screw rod 4*a* fixed to the guide plate 3*a* and passing through and freely slidable through the adjusting plate 3*c* and a nut 4*b*.

The numerals 4*c* and 4*d* designate bolts which are respectively fit to the screw holes near both ends of the guide rod. As shown in FIG. 5, the paper roll S is set to approximately the center of the paper feed box, and the guide adjusting plate 3*c* and the guide plate 3*b* are fixed at proper positions with the bolts 4*c* and 4*d*.

Then, the pressure of the spring 4 is adjusted with the bolts 4*a* and 4*b*.

According to this structure, the paper roll is placed between and pressed by the two guide plates 3*a* and 3*b* in the box 1.

FIG. 2 shows a in which condition the paper roll becomes only to be the paper core C. By the effect of the spring 4 at the constant position, the center of the guide plate 3 in contact with the paper roll S is positioned higher relative to the paper roll as the diameter of the paper roll becomes smaller. By this change, the distance between the two guide plates 3*a* and 3*b* becomes slightly smaller at the upper part than at the lower part, and thereby a downward force acts to prevent upward movement of the paper roll.

As mentioned above, by configuring the device on the drawing side to place the center of pressing the paper roll Q in front of the line traced by the center axis of the paper roll from the start to the end, that is, line 00' in FIG. 2, the drawing force of the unrolled paper F and the weight of the paper roll itself acts to press down the paper roll, both of these forces acting as a couple of forces centered at said pressing center.

According to the present invention, it became possible to always press the paper roll S downward through the drawing force F of the paper roll and the weight of the paper roll itself by making the front side of the side to be the center of pressing. Thus, the paper roll can be unrolled and drawn stably by a simple structure of a small number of parts. Therefore, the cost can be highly reduced and also the movement of paper roll during drawing is eliminated to improve paper feed performance.

In the constitution of the above Example, the rolled direction of the paper roll is make the printing surface of the paper to be incurved and hence the printing surface of the paper roll faces upward when drawn according to the constitution shown in the Figure. Thus, there is no fear that printed surface will be rubbed in the box so as to be injured or contaminated.

The sliding shaft ("2" in FIGS. 1, 2 and 3 and $G_1$ in FIGS. 4 and 5) is in contact by sliding with the blank paper being drawn, so that it imparts reverse curl to the rolled direction of the paper roll to remove the original curl of the rolled paper.

Figure 6:
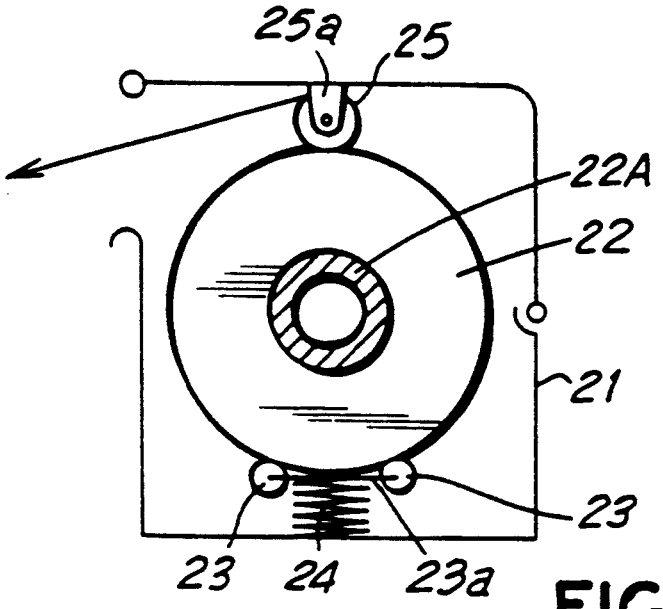
FIGS. 6 and 7 are side sectional views showing the outline of another example of paper feeding equipment of the present invention.
Figure 7:
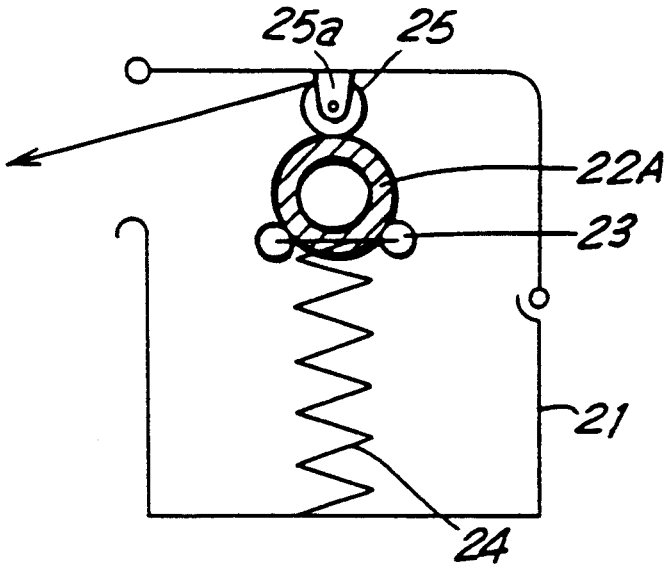

FIGS. 6 and 7 show an Example of a paper feeding device for removing curl of paper roll more effectively and feeding it in a condition suitable for use. The numeral 21 designates a paper-containing box, 22 designates a paper roll which is rolled to make the printing surface inside, 23 designates a pair of holding shafts parallel to the axis of the paper roll for supporting the bottom of the paper roll 22. The pair of holding shafts 23 are united with a member 23*a*, and the member 23*a* is urged upward by a pressing spring 24. The pair of holding shafts may be substituted with a pair of holding rollers.

The numeral 25 designates a sliding shaft for the removal of curl of the paper roll and is provided parallel to the axis of the paper roll provided just above the paper roll by a supporting metal 26*a* fixed to the upper wall of the box to leave a space between the shaft 25 and the upper wall. Hence, the paper of a roll is drawn from the above-mentioned upper wall after going around on the sliding shaft 25 in reverse direction while pressed by the sliding shaft 25 at the upper end and fed to the printing portion.

The curl-removing procedure will be described further.

FIG. 7 shows a condition in which the paper roll 22 is almost disappeared.

The resilience of the spring 24 is proportional to its compression length, and the weight of the paper roll decreases in proportion to the square of the radius of the paper roll. This means that a smaller diameter of the paper roll results in a larger spring force pressing the paper roll 22 on the sliding shaft 5 by the ensemble of the increasing pressure of the spring 24 coupled with the decreasing weight of the roll. This increases the tension applied to the paper roll 22 for paper feed and, thus, enhances the capability of the sliding shaft 25 for removing curl of the paper roll.

The degree of curl of the paper roll is higher when the diameter of the paper roll is smaller, while the capability of removing curl of the paper roll by the sliding shaft 25 is higher when the diameter of the paper roll is smaller. Hence, by selecting properly the spring constant of the spring 24 and its length, a curl-removing capability can be attained corresponding to curl of the paper roll.

As mentioned above, by the constitutions of FIGS. 6 and 7, curl-removing capability of the device is higher when the diameter of the paper roll is smaller and the degree of curl is higher. Thus, the curl can be removed stably and the curl-removing capability of the paper feeding device is further improved to feed the blank paper in a condition suitable for use.

The above effect can be also attained by a simple mechanism to lower the cost.

Figure 7A:
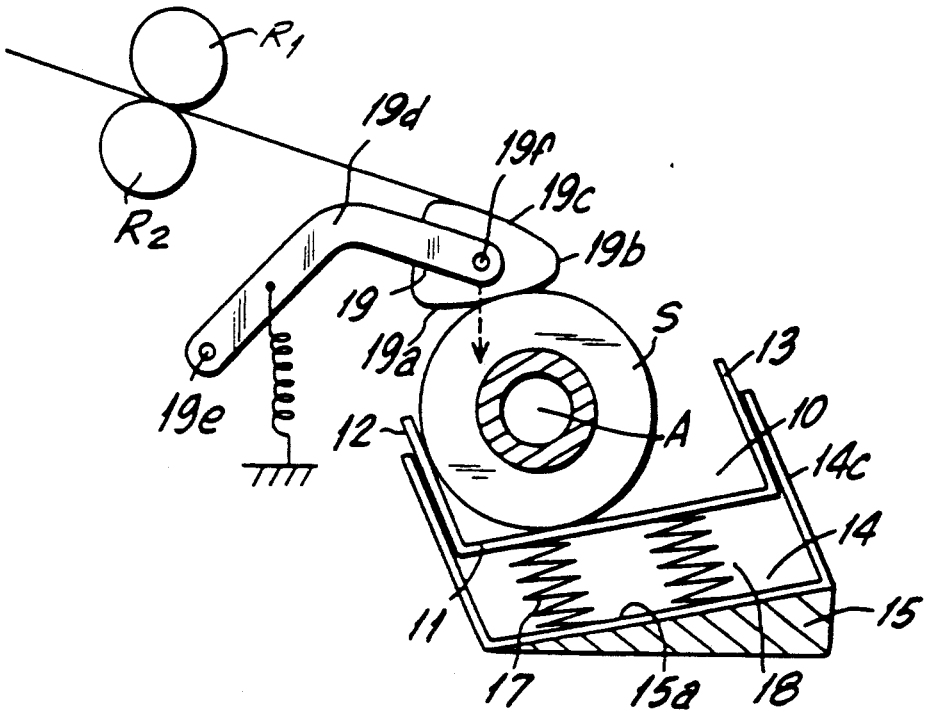
FIG. 7A is a cross-sectional view of a particular embodiment of the present invention for attainment of smooth feeding of paper and removing curl from a rolled paper.

FIG. 7A shows an sectional view of a embodiment of the present invention for attainment of smooth feeding of a paper and removing a curl from a rolled paper, wherein a paper feed box is urged upward to press the paper roll to the slip guide shaft.

Figure 10:
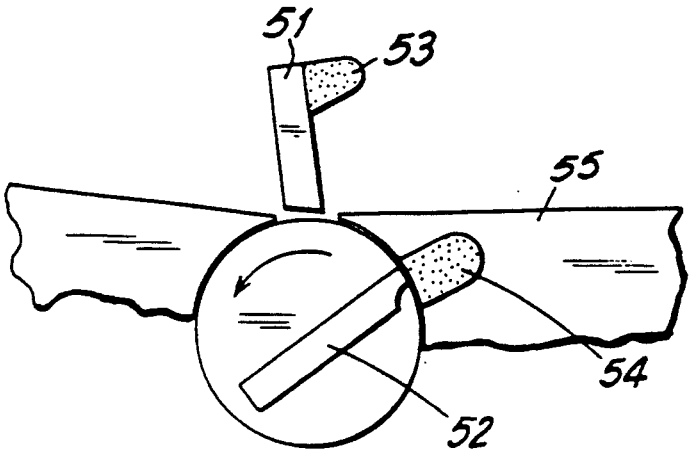
FIG. 10 is a detailed side view of an example of the cutter part succeeding the paper feed part and the printing part in the system.

In FIG. 7A, 10 is a paper feeding box similar to the feeding box described in the paper feeding device of an first example (FIGS. 1 to 5). The 11 of the box 10 and a front wall 12 of the box are somewhat inclined toward a paper draw out side. Also illustrated are the box guide plates 3, 3*a* and 3*b*, an adjusting plate 3*c* and a spring 4, and guide rods G1, G2 (not shown in FIG. 7A).

Numeral 14 is a casing holding the paper feeding box 10 slidably upward and downward. The bottom of the casing 14 is covered with a base member 15 having an upper surface 15*a* parallel to the bottom 11 of the feeding box 14.

The bottom 11 and with surface 15*a* are connected the springs lines 17, 18. Each line has several springs deposited uniformly in a line parallel to the axis of the paper roll. The springs receives the total weight of the paper feeding box and the paper roll, and exert an elastic power urging the casing 14 upwards in proportion to the deformation placed upon them. The springs are able to be replaced to tension springs fixed to a stationary member placed at an upper position (not shown).

Figure 8:
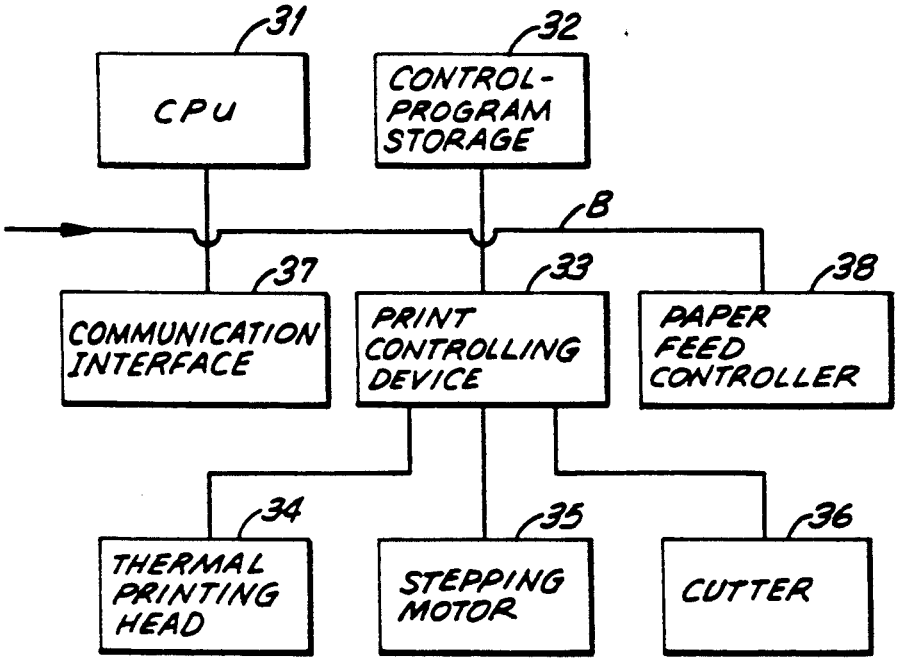
FIG. 8 is the system block diagram of an example of a printer using the paper feeding equipment of the present invention.
Figure 9:
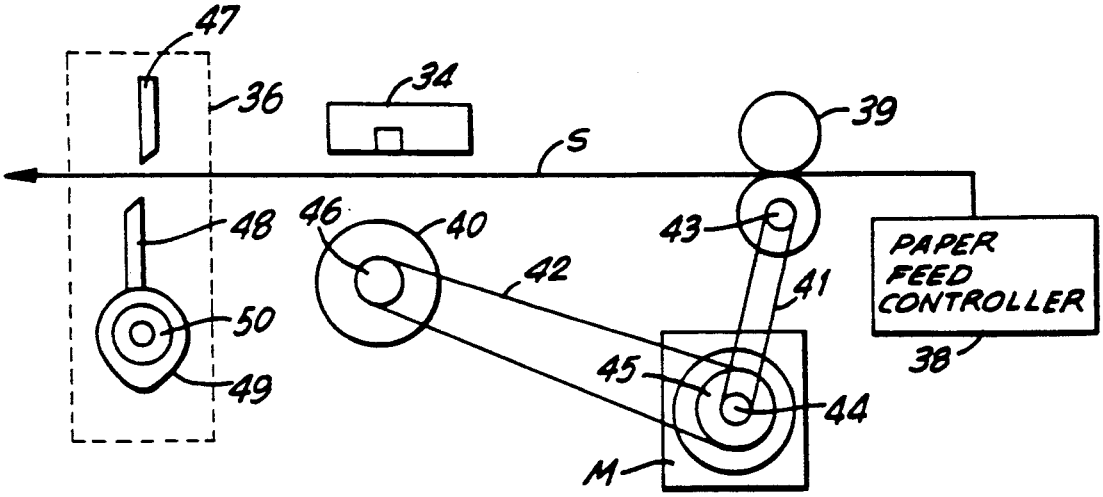
FIG. 9 is a diagram showing the outline of the mechanical constitution of the system.

Numeral 19 is a slipping bar provided in a predetermined position in parallel to the axis of the paper roll to press an upper portion of the roll, which has a lower curved surface 19*a* pressing the roll, a second surface with a strong curved surface 19*b* to remove a curl of rolled paper and a third surface 19*c* to guide an unrolled paper to a paper feeding rollers $R_1$, $R_2$ to be driven with an energized means (illustrated in the FIGS. 8 and 9). The slipping bar also can be configured in a movable manner so as to move downward and somewhat forward (as a curved line L), according to a decrease of a diameter of a paper roll and a displacement of an axis thereof. At the ends there are provided a pair of movable arms 19*d* rotatably supported by a fixed axis 19*e*, with an axis 19*f* holding the slipping bar 19 rotatably in a somewhat small angle so as to adapt the surface 19*a* to the paper roll, and spring means exerting the arm 19*d* to rotate it in a direction of line L. A pair of movable arms hold the slipping bar at the ends of the arm 19*d* by an axis 19*f*.

Figure 7B:
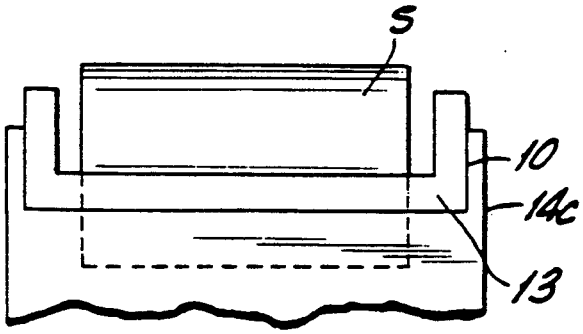
FIG. 7B is a partial sectional view of the above embodiment illustrating back walls with a removed portion to facilitate the setting and taking out of a paper roll to and from the paper feeding box.

FIG. 7B shows an example of the back walls 13 and 14*c* with a removed portion to facilitate the setting and taking out of a paper roll to and from the paper feeding box.

According to the embodiment of FIG. 7A, a roller paper is unrolled smoothly and constantly, by means of contact of the roll to both the bottom 11 and the front wall 12, and the pressing holding from the sides of the roll, and in other words an curl of the rolled paper can be removed in a improved way, by means of the compression contact of the paper roll and the slipping bar 19 exerting increasing force on the roll in response to the decreasing weight of the roll in the course of paper feeding.

FIGS. 8 and 9 show in outline a configuration of a printer which can be used efficiently and in a stable manner to feed blank paper by using the above paper feeding device. FIG. 8 is a block diagram showing the system constitution. FIG. 9 is an outlined drawing showing its materialized example of constitution.

In FIG. 8, the notation B designates the bus line, the numeral 31 designates a CPU, 32 a control program storage, 33 a print controlling device, 34 a thermal printing head, 35 a stepping motor for driving recording paper, 36 a cutter for cutting the paper at a desired position, 37 a communication interface for exchanging information with exterior system equipment, and 35*a* the paper feeding and controlling device for the feed and control of the blank paper.

In the control program storage 32, a program for controlling the cutter movement in relation to the printing movement and the sheet feeding movement and others are stored in addition to basic printer programs such as a data editing program and a print control program, etc. Based on these programs, the thermal head 34, the stepping motor 35 and the cutter 36 are controlled by the CPU 31.

FIG. 9 shows an example of the mechanical constitution of the equipment of FIG. 8. The notation S designates a recording paper, the numeral 38 designates a sheet feed controller, 39 a press roller, 40 a platen roll pressing the blank paper and the printing head 34 during printing, 41 a sheet driving belt, 42 a platen driving belt, 43, 44, 45 and 46 belt pulleys and the notation M designates a driving motor.

The cutter 36 is provided downstream of the print head 34 and is constituted, for example, by a fixed blade 47, a rise and fall blade 48, an eccentric cam 49 moving the rise and fall blade 48 and a cutter drive motor 50. The rise and fall blade 48 can be replaced by a rotary blade.

The paper feeding equipment of the present invention can additionally include the following feature to the constitution of the cutter when the blank paper is an adhesive paper.

FIG. 10 shows an embodiment of a cutter for adhesive paper. In a rotary cutter combining a stationary straight blade and a rotary blade of partial spiral form for preventing adhesion of the adhesive on the blade of the cutter during cutting an adhesive paper, a porous member impregnated by a releasing agent is provided on the upper part of the stationary blade and another porous member impregnated by a releasing agent is also provided in a retracted position relative to the cutting position of the rotary blade so that the latter porous member contacts the blade face of the rotary blade during rotated.

In FIG. 10, the numeral 51 designates a stationary blade fixed approximately upright and a porous member 53 impregnated by a releasing agent is provided on the upper part of the blade face. The blade face on the side of porous member 53 is slanted slightly to the back thereof so that the releasing agent impregnated in the porous member 53 can wet the blade face by passing the blade.

The numeral 52 designates the rotary blade forming the part of the spiral. The rotary blade 52 is adapted to cut the adhesive paper by contacting the blade face of the fixed blade 51.

The numeral 54 designates a porous member fit in the dent of the cutter platform 55 and a releasing agent is impregnated in it.

The blade face of the rotary blade momentarily contacts the porous member 54 in each rotation to be wet by the releasing agent impregnated in the porous member. The releasing agent may be any volatile liquid which does not dissolve the adhesive and water can be commonly used.

By the constitution of FIG. 10, the releasing agent 53 always wets the blade face of the stationary blade 51 from the porous member 53 and the blade face of the rotary blade 52 contacts the porous member 54 in each rotation to be wet by the releasing agent. Hence, when the adhesive paper is cut by the two blades 51, 52, the adhesive is not transferred to the blade faces to enable stable cutting of the adhesive paper. By this constitution, the difficulties were eliminated that the adhesive accumulates on the blade face and the cut adhesive paper adheres to the cutter blades and the cutting capacity is lowered.

Accordingly, the equipment of the present invention can be stably operated not only for printing on a common blank but also for a printer equipped with a cutter which is used for printing and cutting the label blank usually having an adhesive surface layer.

As mentioned above, according to the present invention, many difficulties in the use of paper roll including unstable blank paper feed by the movement of the roll and curling of the blank paper caused by the curl of the roll could be eliminated by a simple constitution to enable a stable blank paper feed to the printer.

Furthermore, the problem of transferring adhesive in the printing and cutting of adhesive paper was also eliminated and the utilization efficiency of a printer could be enhanced for the use of a higher variety of the blanks.

What we claim is:

1. A device for feeding paper from a paper roll comprising a paper feed box having a bottom slanting to the front and a front wall for containing the paper roll so that said paper roll freely contacts both of said bottom and said front wall, said paper feed box being supported by a spring at the undersurface of the paper feed box and capable of rising and falling, said device further comprising slip guide means provided at a predetermined position above said paper feed box so that when the paper roll is placed in said paper feed box, the upper end of said paper roll is pressed to said guide means and unrolled paper from said roll is drawn around said guide means.

2. A device for feeding paper according to claim 1, wherein said spring is constructed so as to generate an increasing compression between said slip guide means and said paper roll according to a decrease in the diameter of the paper roll.

3. A device for feeding paper according to claim 1, further comprising means for tensioning the paper as it is drawn from said paper roll, so that the paper is fed smoothly, constantly and without curl.

4. A device for feeding paper according to claim 1, wherein said slip guide means is provided with another spring means for urging and pressing said slip guide to the upper surface of said paper roll in response to decreasing weight of said paper roll.

* * * * *